United States Patent [19]

Nieto-Busby et al.

[11] Patent Number: 4,892,357

[45] Date of Patent: Jan. 9, 1990

[54] CHILD'S PORTABLE AUXILIARY SEAT CUSHION WITH UPPER BODY SUPPORT RIDGE

[76] Inventors: Adriana Nieto-Busby; Guadalupe Nieto, both of 838 Vinemead Dr., Whittier, Calif. 90601

[21] Appl. No.: 184,299

[22] Filed: Apr. 21, 1988

[51] Int. Cl.[4] ..... A47C 20/00; A47C 7/02; A47C 31/00

[52] U.S. Cl. ..... 297/464; 5/432; 297/231; 297/455

[58] Field of Search ..... 297/464, 231, 230, 229, 297/455; 5/431

[56] References Cited

U.S. PATENT DOCUMENTS

| | | | |
|---|---|---|---|
| 1,927,331 | 9/1933 | Wittcoff | 297/229 |
| 2,734,556 | 2/1956 | Hebrank | 297/230 |
| 4,383,713 | 5/1983 | Roston | 5/431 X |
| 4,457,032 | 7/1984 | Clarke | 297/230 X |
| 4,565,405 | 1/1986 | Mayer | 297/230 |
| 4,568,125 | 2/1986 | Sckolnik | 297/229 X |
| 4,712,258 | 12/1987 | Eves | 5/431 X |

FOREIGN PATENT DOCUMENTS

| | | | |
|---|---|---|---|
| 1253964 | 1/1961 | France | 5/432 |

*Primary Examiner*—James T. McCall

[57] ABSTRACT

The improved portable auxiliary seat cushion with upper body support for children is described as an elongated mat comprising four layers; the front and the back layers which are composed of a durable machine washable fabric, and the interfacing and fiber filled layers which are interposed between the front and back layer. The four layers are peripherally interconnected into a unitary structure by a continuous stitching at the perimeters thereof. A straight stitch at the hinge defines a back rest and seat portion. Slits, one on each side below the hinge, provide slots for seat belt. An upper body support ridge comprises five parts: The support ridge filler, which is made of a firm, yet resilient, material; the outermost, innermost, and uppermost sections; and the bottom ends, which create a tubular form. A zipper is attached centrally to the outermost section for easy removal of the ridge filler to facilitate laundering. The upper body support ridge is attached to the upper perimeters of the back rest projecting forwardly thereof. The top of the backrest is in the shape of an arch whereby keeping the support ridge firmly in place. There are four snaps; one on each side, attached to the bottom ends of the upper body support ridge and one on each side of the seat portion neighboring the slits. These snaps may be snapped together to retain cushion in an upright seated position when placed on an underlying support structure, such as the seat of an automobile or a child's safety booster seat. The snaps can be left open allowing the cushion to be placed in a horizontal position on a flat surface, converting into a cushioned, comfortable mat for the child to lay on when in a recumbent position.

4 Claims, 2 Drawing Sheets

CHILD'S PORTABLE AUXILIARY SEAT CUSHION WITH UPPER BODY SUPPORT RIDGE

FIELD OF THE INVENTION

This invention relates to a portable auxiliary seat cushion with an upper body support of the type used by children on chairs or other support structures in the home or while riding in a moving vehicle, particularly while strapped into a seat belt or using a child's booster safety seat.

More specifically, the present invention relates to a portable auxiliary seat cushion which gives upper body support and comfort by means of a ridge peripherally connected around the upper outer portion of the backrest and projecting forwardly thereof.

The present invention can also be directed to a seat cushion that can be placed horizontally on a flat surface thereby providing a soft, comfortable mat for a child when in a recumbent position.

PRIOR ART

Heretofore a child riding in a vehicle and wearing a seat belt had nothing to support his/her upper body comfortably and upright. If a child fell asleep while strapped into a seat belt or a safety booster seat, the child's upper body would invariably fall forward or sideways creating a very uncomfortable posture for the child. Furthermore, the effectiveness of the safety belt is lessened while the child is not in an upright position. Previously, seat cushions have not provided adequate head and shoulder support for a child.

Typical of such portable seat cushions is that shown and described in Clarke U.S. Pat. No. 4,457,032 issued July 3, 1984 in which a seat pad and backrest provide comfort but do not provide support for the shoulders and head.

Mayer, U.S. Pat. No. 4,565,405 issued Jan. 21, 1986 shows a portable seat cushion with connected headrests, here again there is no support provided for the shoulders. The thick layer of resilient material used for the seat pad and backrest make it impractical for use with automobile seat belts or a children's safety booster seat.

Also typical of portable seat cushions is that shown and described in Roston U.S. Pat. No. 4,383,713 issued May 17, 1983 in which support is given to the upper body of occupant, however, no seat portion is included.

Another previous art presently on the market, however not patented, is a seat cushion for infants "Comfy Rider". This seat cushion is not designed to be used without an infant's car seat. Its structure is not suitable for use with standard automobile seat belts or a child's safety booster seat. It is not intended for toddlers or children over 21 pounds in weight. It is apparent from the foregoing that previously available portable auxiliary seat cushions were not suitable in adding significant support and comfort for a child while strapped into a seat belt or safety booster seat.

It is an object of the present invention that a child may be strapped into a standard automobile seat belt or a children's safety booster seat and be comfortably supported and cradled by the portable auxiliary seat cushion while said child sits safely and securely in an automobile or other seating structure.

Another object of the invention is to provide a cover for the existing seat structure on which the portable seat cushion is placed and on which the child then sits thereby protecting the child's legs from hot or cold vinyl upholstery. At the same time the portable seat cushion protects the existing seat covers from the wear and tear of an active child.

It is yet another object of this invention to provide an improved auxiliary seat cushion wherein the backrest and bottom seat section could be laid out flat in a horizontal position, converting into a comfortable, portable mat for a child to lay on while in a recumbent position.

Lastly, it is yet another objective of this invention to provide a portable auxiliary seat cushion that is durable and fully machine washable as evidenced, as evidenced by the addition of a zipper attached to the outermost section of the support ridge making the removal of the ridge filler easy and convenient.

SUMMARY OF THE INVENTION

The foregoing and other objects of the invention are achieved by providing a portable auxiliary seat cushion comprising a seat panel and a backrest panel with an upper body support ridge peripherally connected around the upper perimeter of the backrest and projecting forwardly thereof. The top of the backrest portion is arched to securely keep the support ridge in a forwardly projected position.

Both backrest and seat portion comprise an upper layer and interfacing layer which are fiber filled providing a comfortable cushioned surface. The upper body support ridge is comprised of: innermost, uppermost and outermost sections which are filled with a firm, yet resilient material, such as, but not exclusive to, foam rubber. It provides soft, resilient and comfortable upper body support for the child. It should be noted that the support ridge has a zipper attached to the outermost section thereby providing easy access for the removal and insertion of the ridge filler, making the auxiliary seat cushion machine washable.

All materials used in the construction of said seat cushion would be made of durable, machine washable fabrics and fiber filler, except the upperbody support ridge filler, which is easily removed when necessary for washing.

The child's portable auxiliary seat cushion is specifically designed and created for the comfort of toddlers and children who must be strapped into an automobile safety belt or a safety booster seat and who have out grown the use of a child's automobile safety seat. However, it can be used in boats and on household furniture. Not only does the auxiliary seat cushion aid in the comfort of the child, it also protects the child's legs and back from hot or cold vinyl upholstery, and at the same time provides protection to seat covers from wear and tear by the child.

When placed horizontally on a flat surface, the child's portable auxiliary seat cushion converts into a comfortable secure mat for the child to lie on. The upperbody support ridge is firm yet resilient whereby providing some protection for the child from rolling out.

BRIEF DESCRIPTION OF DRAWINGS

FIG. 1 also shows the arch shape at the top of the backrest portion.

Specifications - List of reference numerals

Figure 2:
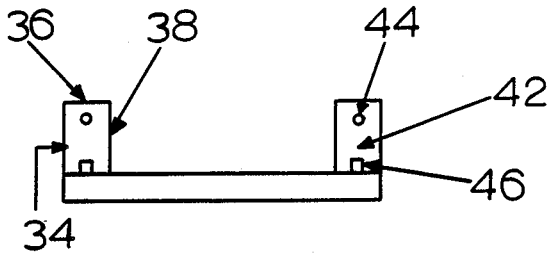
FIG. 2 shows bottom view along lines 2—2 of FIG. 1 showing forwardly projection of upper body support ridge and snaps on the bottom ends.

20 backrest
22 seat
24 upper body support ridge
26 front layer
28 fiber fill layer
30 interfacing layer
32 back layer
34 outermost section of 24
36 uppermost section of 24
38 innermost section of 24
40 continuous zipper on outside of 24
42 bottom of 24
44 top snap
46 bottom snap
48 upper body support ridge
50 slits
52 hinge
54 arch

DETAILED DESCRIPTION OF EMBODIMENT OF THE INVENTION

Referring to the drawings, the child's portable auxiliary seat cushion with upper body support consists of an elongated mat (FIG. 2) comprising 4 layers; the front layer (26) and the back layer (32) are optionally composed of a durable, washable fabric such as, but not exclusive to, corduroy or canvas, an interfacing layer (30) composed of a washable somewhat stiff fabric to give seat cushion substance, and finally, a fiber fill layer (28) which can be any soft, washable fiberous material known to the art.

Figure 1:
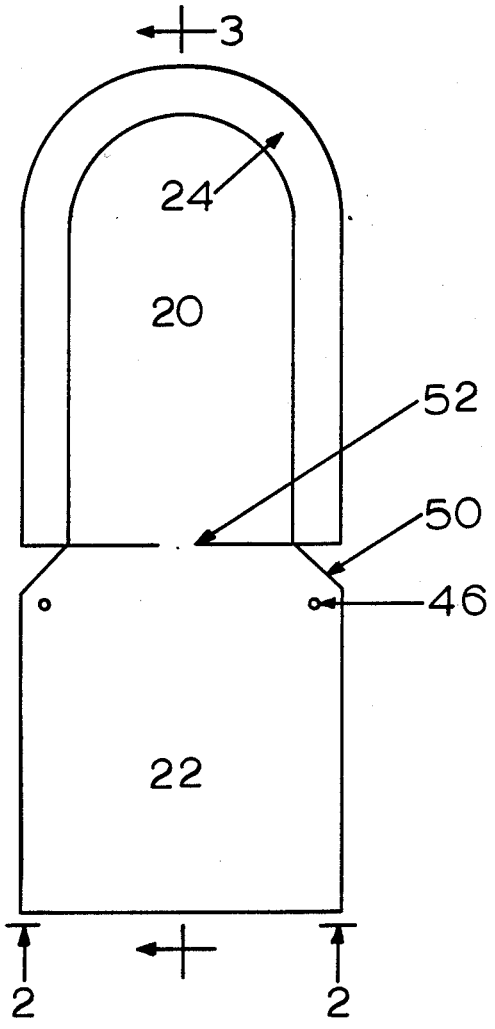
FIG. 1 shows the front plan view of the portable seat cushion including upper body support ridge, back rest and seat, it also shows snaps below the slits.
Figure 3:
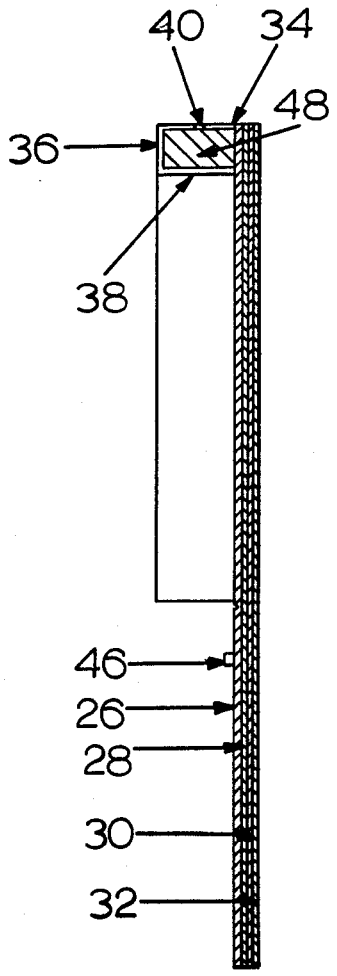
FIG. 3 is a sectional view along lines 3—3 of FIG. 1 showing the front layer, fiber filled layer, interfacing layer and back layer. It also shows the forwardly projection of the upper body support ridge.
Figure 4:
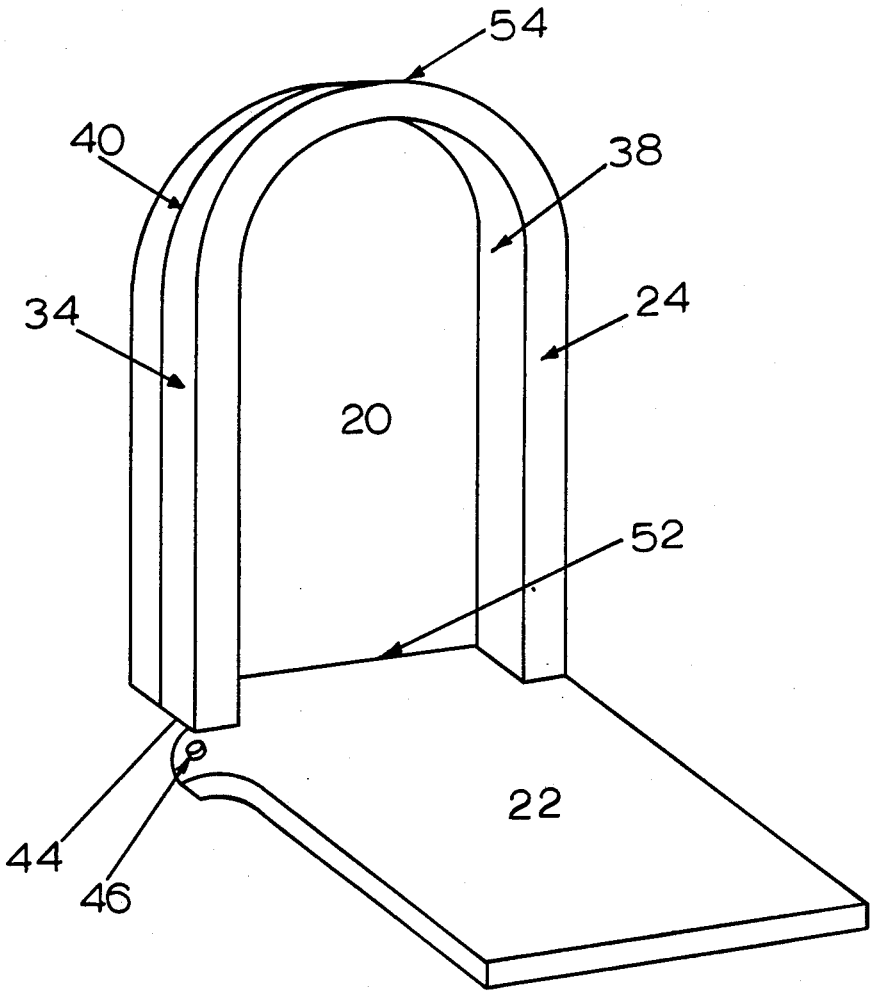
FIG. 4 shows a perspective view of the portable auxiliary seat cushion in a seated upright position.

As illustrated in FIG. 3, the front layer (26), fiber filled layer (28) and the interfacing layers (30) of the seat cushion are interconnected at the hinge. The elongated mat structure of FIG. 1 is also divided into a backrest (20) and a seat (22) portion by stitching at the hinge (52). The hinge (52) is created by joining the front layer (26), the fiber fill layer (28) and the interfacing layer (30) by any suitable straight stitch known the the art. The top of the backrest (20) is in the shape of an arch (54), so illustrated in FIG. 1, whereby keeping the support ridge (24) firmly in place. There are two V-shaped slits (50), one on each end of the hinge (52) providing a place for safety seat bels, these also facilitate the folding up of the seat portion's sides for a better fit into a child's booster safety seat.

In the illustrative embodiment of FIG. 2 the upper body support ridge (24) comprises 4 sections: the outermost section (34), the uppermost section (36), the innermost section (38) and the bottom section (42). A zipper (40) is attached centrally to the length of the outermost section (34) thus facilitating the removal of the upper body support ridge filler (48). The outermost section (38), uppermost (36) and innermost sections are connected by stitching one edge of the innermost section (38) to the inner edge of the uppermost section (36) and one edge of the outermost section (34) to the outer edge of the uppermost sections (36). The open edge of the innermost section (38) and outermost sections (34) of the support ridge (48) are connected to the backrest (20) by means of a continuous peripheral stitching around the upper perimiter of the backrest (20). By stitching it is meant any suitable straight stitch known to the art. A square piece of material is sewn into the open ends of the support ridge (48) to enclose the bottom (42).

The support ridge filler (48) should be made of a firm, resilient material, such as, but not exclusive to, foam rubber. The filler (48) should be formed to fit inside the assembled support ridge exterior and can be inserted and removed as necessary for washing by means of the zipper (40).

The back panel (32) illustrated in FIG. 3 is sewn onto the backside by a continuous peripheral stitching around the parimeter of the already assembled front layer (26), fiber filled layer (28), interfacing layer (30) and upper body support ridge (24). The child's portable auxiliary seat cushion with upper body support ridge is completed by the securing of the snaps (44 and 46) which are attached by any means known to the art. Snaps (46) are attached to the seat (24) one on each side neighborng the slits (50). The two upper snaps (44) are attached to the bottom (42) section of the support ridge, one on each side. The snaps (44 and 46) should be positioned so that they connect when the child's portable seat cushion is in an upright position. When snaps are snapped together, the upper body support ridge (28) is held firmly in place, whereby comfortably supporting the child's shoulders and head in an upright, seated position. The child's portable seat cushion can be used with standard automobile safety seat belts or with a child's booster safety seat. The snaps provide a slot in which to slip the seat belt through. The snaps can also be left unsnapped in order to lay seat cushion down horizontally on a flat surface, as in FIG. 2, to be used as a cozy, cushioned mat for a child while sleeping, having diapers changed or otherwise, while in a recumbent position.

Thus it can be seen that the child's auxiliary portable seat cushion is a practical, beneficial device that can be used by parents for the comfort of their children while traveling or at home. The parents will find that a child no longer falls sideways or forwardly while sleeping strapped into a seat belt, but instead, will be held comfortably snug and upright while using the child's portable auxiliary seat cushion with upper body support.

While the above description contains several specifications, it should not be construed that as limitations on the scope of the invention, but merely as exemplifications on the embodiments thereof. Other variations are within the scope of the invention. One skilled in the art would be able to change the size and shape of the various embodiments. They can change the materials used. For example, they may choose to use non-washable fabric such as leather. They may also create the seat cushion by using one big form of foam rubber and upholster it. In fact, one skilled in the art could create the portable seat cushion by using a plastic form. Accordingly, the scope of the invention should be determined not by the embodiments illustrated but by the claims and their legal equivalents.

Having described the portable auxiliary seat cushion for children, reference should now be had to the following claims.

We claim:

1. A child's portable auxiliary seat cushion with upper body support ridge comprising an oblong mat of a predetermined size comprising a front layer and a back layer; interposed between said front layer and said back layer are a fiberfilled layer and an interfacing layer, both the same shape as said front layer, a continuous securing means extends around the perimeters of, and peripherally interconnects said front, fiber-filled, interfacing and back layers, stitching at the hinge defines a seat portion and backrest, said seat portion comprises: two slits, one on each side adjacent to hinge, as means for inserting a seat belt and making said seat portion pliable enough to accommodate a safety booster seat, said backrest portion comprises a ridge, upper body support means, peripherally connected to the upper outer perimeters of said backrest portion and projecting forwardly thereof, said ridge comprising an innermost, uppermost, outermost and bottom section, creating a tubular form as means for retaining a ridge filler which is made of a firm, yet resilient material such as, but not exclusive to, foam rubber.

2. The child's portable auxiliary seat cushion with upper body support of claim 1 wherein said seat portion comprises two male snaps, one on each side of neighboring said slits and wherein said bottom ends of said ridge comprise one female snap each as means for snapping said male snaps to said female snaps together whereby retaining said oblong mat in a seated position.

3. The child's portable auxiliary seat cushion with upper body support of claims 1 and 2 wherein said outermost section of said ridge comprises a zipper, or other securing means known to the art, attached centrally to the length of said outermost section as means for removing said ridge filler whereby rendering said seat cushion washable.

4. The child's portable auxiliary seat cushion with upper body support ridge of claims 1, 2, and 3 wherein top end of said oblong mat is in the shape of an arch, whereby maintaining said ridge in a forwardly projected position, as means for supporting occupant's upper body.

* * * * *